US010424427B2

(12) United States Patent
Furukawa

(10) Patent No.: US 10,424,427 B2
(45) Date of Patent: Sep. 24, 2019

(54) SUPERCONDUCTING COIL

(71) Applicant: FURUKAWA ELECTRIC CO., LTD., Tokyo (JP)

(72) Inventor: Makoto Furukawa, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 410 days.

(21) Appl. No.: 15/228,953

(22) Filed: Aug. 4, 2016

(65) Prior Publication Data

US 2016/0343492 A1 Nov. 24, 2016

Related U.S. Application Data

(63) Continuation of application No. PCT/JP2015/052332, filed on Jan. 28, 2015.

(30) Foreign Application Priority Data

Feb. 5, 2014 (JP) ..... 2014-019989

(51) Int. Cl.
*H01F 6/00* (2006.01)
*H01F 6/06* (2006.01)

(52) U.S. Cl.
CPC ..... *H01F 6/06* (2013.01)

(58) Field of Classification Search
CPC ..... H01F 6/06
USPC ..... 335/216
See application file for complete search history.

(56) References Cited

U.S. PATENT DOCUMENTS

2011/0291782 A1* 12/2011 Calvert ..... G01R 33/3802 335/299
2012/0135868 A1* 5/2012 Huang ..... H01F 6/04 505/211
2014/0155269 A1* 6/2014 Daibo ..... H01F 6/06 505/211

FOREIGN PATENT DOCUMENTS

| | | | | |
|---|---|---|---|---|
| CN | 1127050 | A | 7/1996 | |
| CN | 102142311 | A | 8/2011 | |
| CN | 102314987 | A | 1/2012 | |
| JP | S63219106 | A | 9/1988 | |
| JP | 2010267822 | A | 11/2010 | |
| JP | 2011198469 | A | 10/2011 | |
| JP | 2013055265 | A | 3/2013 | |
| JP | 2014022693 | * | 2/2014 | ..... H01F 6/06 |
| JP | 2014022693 | A | 2/2014 | |
| JP | 2015012199 | A | 1/2015 | |
| JP | WO2013187353 | A1 | 2/2016 | |
| WO | 2013187353 | A1 | 12/2013 | |

OTHER PUBLICATIONS

Extended European Search Report for European Application No. 15746462.9, dated Feb. 23, 2018, 5 pages.

(Continued)

*Primary Examiner* — Shawki S Ismail
*Assistant Examiner* — Lisa N Homza
(74) *Attorney, Agent, or Firm* — Amin, Turocy & Watson, LLP

(57) ABSTRACT

A superconducting coil includes a superconducting wire wound around an axis, a release material layer between the superconducting wires adjacent in a radial direction and at both ends in an axial direction of the superconducting coil, and a resin layer between the superconducting wires adjacent in the radial direction and in a region other than a region where the release material layer is formed.

7 Claims, 8 Drawing Sheets

(56) References Cited

OTHER PUBLICATIONS

Chinese Office Action dated Mar. 8, 2017 in Chinese Application No. 201580004068.X, 11 pages (including translation).
Japanese Office Action dated Jun. 25, 2018 for Japanese Patent Application No. 2015-560945, 6 pages (with translation).
Chinese Office Action dated Aug. 14, 2017 in Chinese Application No. 201580004068X, 5 pages (including translation).
International Search Report and Written Opinion for PCT Application No. PCT/JP2015/052332, dated Apr. 21, 2015, 3 pages.
International Preliminary Report on Patentability for PCT Application No. PCT/JP2015/052332, dated Aug. 9, 2016, pages (with translation).
Written Opinion of the International Searching Authority for PCT Application No. PCT/JP2015/052332, dated Apr. 21, 2015, 7 pages (with translation).
European Office Action dated Dec. 19, 2018 for European Patent Application No. 15746462.9, 5 pages.

* cited by examiner

SUPERCONDUCTING COIL

CROSS REFERENCE TO RELATED APPLICATIONS

This is a continuation application of International Patent Application No. PCT/JP2015/052332, filed Jan. 28, 2015, which claims the benefit of Japanese Patent Application No. 2014-019989, filed Feb. 5, 2014, the full contents of all of which are hereby incorporated by reference in their entirety.

BACKGROUND

Technical Field

The present disclosure relates a superconducting coil.

Background

It is known to impregnate a superconducting coil with a resin or the like to fix and increase the strength of the superconducting coil as a whole and also to prevent lowering of the thermal efficiency of the superconducting coil.

Impregnation is performed by, for example, immersing a superconducting coil into a mixture of an impregnation material such as an epoxy resin and a crosslinking agent, and then pulling vacuum to spread the mixture between wires forming the superconducting coil, and allowing the mixture to cure. However, when a superconducting coil impregnated with epoxy resin is cooled, delamination may occur between layers of the wire and this causes a decrease in critical current. Alternatively, paraffin may be used as an impregnation material in place of an epoxy resin, but peelings may occur between the wire and paraffin or within a paraffin layer and this leads to a decrease in thermal efficiency of the coil.

In view of the above, a superconducting coil has been proposed that employs an instant glue as an impregnation material to eliminate delamination of the wire due to thermal stress, and thus capable of preventing a decrease in performance (e.g., see Japanese Laid-Open Patent Publication No. 2013-55265).

As another example, a superconducting coil has been proposed which is constituted by winding a coil wire and an insulation material that are tape-like, and applying a releasing treatment to a face of the tape-like insulation material excluding a portion other than both end portions in a width direction (e.g., see Japanese Laid-Open Patent Publication No. 2010-267822).

Further, as another example, a superconducting coil has been proposed that has a release material layer formed on an entire side face of the insulation material layer disposed between adjacent superconducting wires (e.g., see Japanese Laid-Open Patent Publication No. 2011-198469).

In a superconducting coil, during the cooling after impregnation, a delamination force (a stress acting in a thickness direction of the superconducting wire) is produced inside the superconducting wire due to a difference in thermal shrinkage between the impregnation material and the superconducting wire. Since this delamination force acts particularly largely on a superconducting wire located on both end portions in an axial direction of the superconducting coil, there is a large difference in delamination forces between these end portions and a region other than these end portions.

Therefore, it is necessary that the impregnation material peels more easily than the superconducting wire at both end portions in the axial direction of the coil, and that the impregnation material does not easily peel in a region other than the both end portions to strengthen the entire coil.

According to Japanese Laid-Open Patent Publication No. 2013-55265, the aforementioned drawbacks cannot be overcome, since merely one type of quick-setting adhesive is used.

Also, according to Japanese Laid-Open Patent Publication No. 2010-267822, the aforementioned drawbacks cannot be overcome, since a release process is applied to the region other than the end portion in a width direction of the insulating tape.

Also, according to Japanese Laid-Open Patent Publication No. 2011-198469, the aforementioned drawbacks cannot be overcome, since a release material layer is formed on the entire side face of the insulation material layer.

Therefore, with the conventional art described above, it is difficult to achieve prevention of delamination of the superconducting wire at both end portions in an axial direction of the coil, and also to achieve a secure fixing of the superconducting coil as a whole and prevention of a decrease in thermal efficiency.

The present disclosure is related to providing a superconducting coil that can achieve prevention of delamination in the superconducting wire at both end portions in an axial end of the coil, and can achieve a secure fixing of the superconducting coil as a whole and prevention of lowering of thermal efficiency.

SUMMARY

According to an aspect of the present disclosure, a superconducting coil includes a superconducting wire wound around an axis, a release material layer between the superconducting wires adjacent in a radial direction and at both ends in an axial direction of the superconducting coil, and a resin layer between the superconducting wires adjacent in the radial direction and in a region other than a region where the release material layer is formed.

It is preferable that a length of the release material layer in the axial direction is 10% to 50% of a length of the superconducting wire in the axial direction.

It is preferable that a length of the release material layer in the axial length becomes shorter from an inner side to an outer side along a radial direction of a coil.

It is preferable that a release material of the release material layer is at least one of cyanoacrylate-based adhesive, paraffin, fluorine-based resin, grease, and silicone oil.

It is preferable that a release material of the release material layer is a resin tape having an adhesive layer.

It is preferable that a resin of the resin layer is a thermosetting synthetic resin.

It is preferable that the thermosetting synthetic resin is at least one of an epoxy resin, a phenolic resin, a urea resin, and a melamine resin.

It is preferable that the resin layer is formed by impregnation of the thermosetting synthetic resin.

According to the present disclosure, it is possible to achieve prevention of delamination in the superconducting wire at both end portions in an axial end of the coil, and to achieve a secure fixing of the superconducting coil as a whole and prevention of a lowering in thermal efficiency.

DETAILED DESCRIPTION

A preferred embodiment of the present disclosure will be described with reference to the accompanying drawings. It is to be noted that the embodiment shown below is an exemplary embodiment, and various embodiments are feasible within in the scope of the present disclosure.

<Superconducting Coil>

Figure 1:
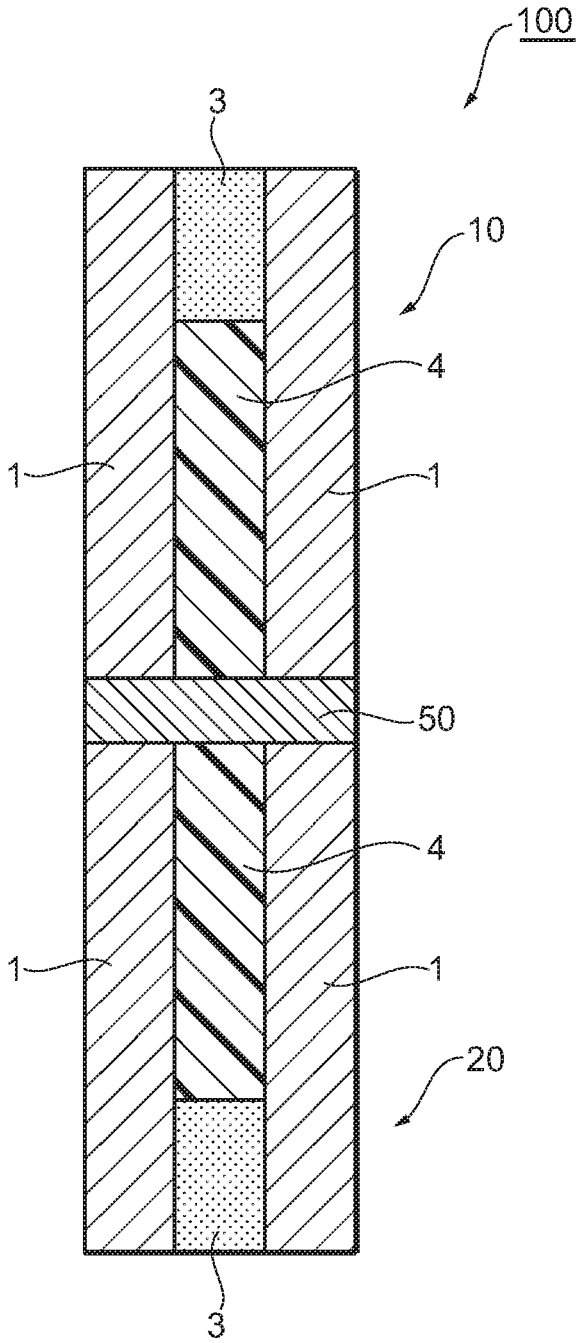
FIG. 1 is a cross sectional view of a part of a superconducting coil.
Figure 2B:
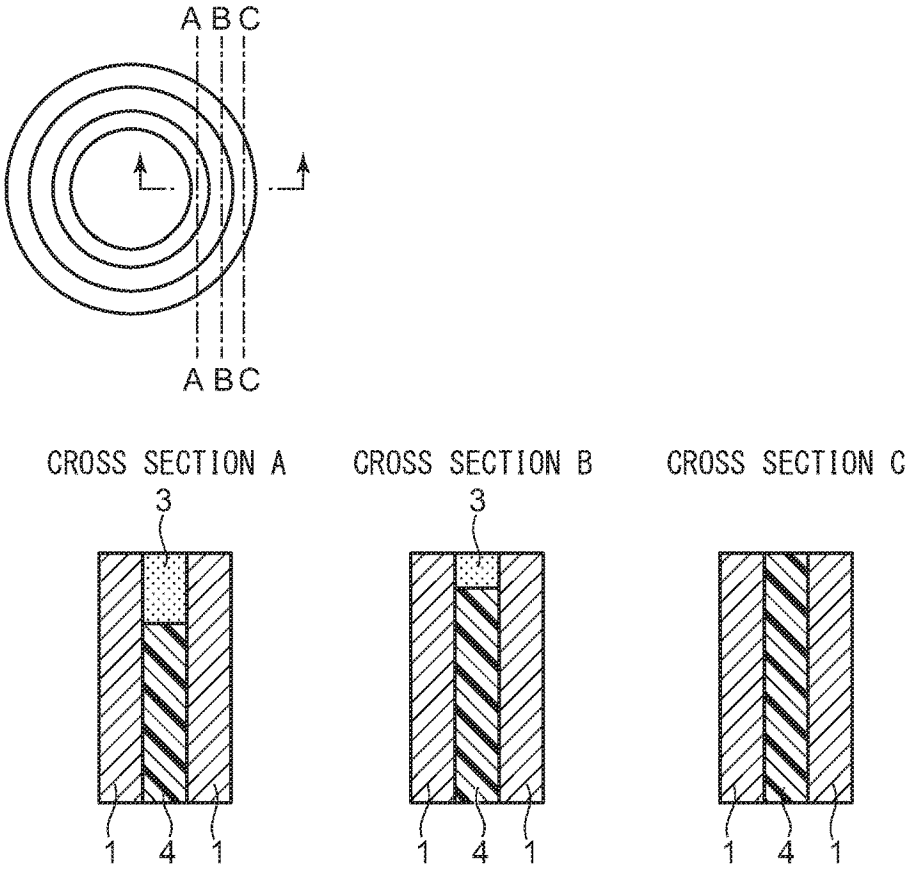
FIG. 2B is a schematic diagram showing a change in cross section in the radial direction of the superconducting coil.
Figure 2A:
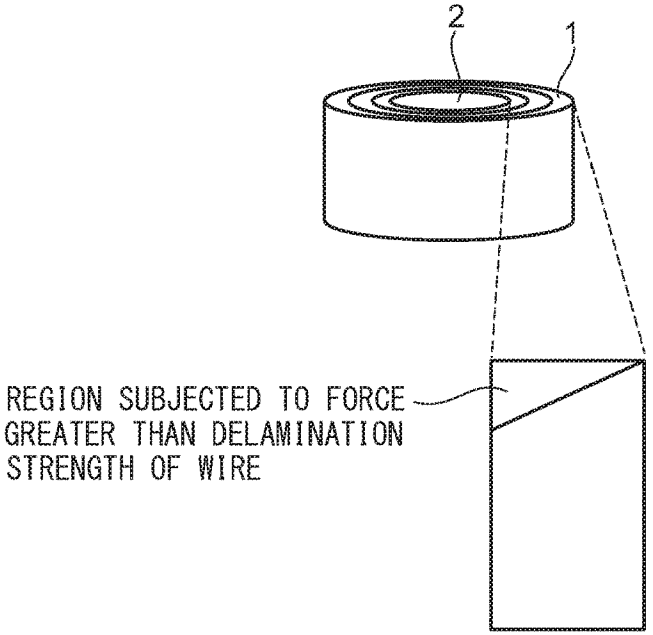
FIG. 2A is a schematic diagram showing a region subjected to a force greater than a delamination strength in a wire in a radial direction of the superconducting coil.

As shown in FIGS. 1, 2A and 2B, a superconducting coil 100 is a coil that is a so-called double pancake coil. The superconducting coil comprises two layers of coils 10 and 20 that are stacked in an axial direction of the coils 10 and 20, and partitioned with a partitioning board 50.

The superconducting coil 100 includes a tape-like superconducting wire 1 comprising a plurality of layers and wound on a cylindrical core material 2 about an axis, and a release material layer 3 and a resin layer 4 are formed between adjacent superconducting wires 1. The superconducting coil 100 is fabricated by winding the superconducting wire 1 around the core material 2 formed of FRP or the like, and forming the release material layer 3 and the resin layer 4 between adjacent superconducting wires 1 during or after the step of winding the superconducting wire 1 on the core material 2.

The superconducting wire 1 is a tape-like superconducting wire, and, for example, obtained by laminating an yttrium-based super conducting layer on a metal substrate via an intermediate layer, and laminating a protective layer such as silver on the superconducting layer.

(Release Material Layer)

The release material layer 3 is formed between adjacent superconducting wires 1 wound around the core material 2. The release material layer 3 is formed with a predetermined length from each end portion in the axial direction of the wound superconducting wire 1 towards an opposite end portion. Specifically, it is preferable that the length of the release material layer 3 at one end portion in the axial direction of the coil is within a range of 5% to 25% to the length of the superconducting wire 1 in the axial direction, and 10% to 50% for the sum of both end portions.

Figure 3:
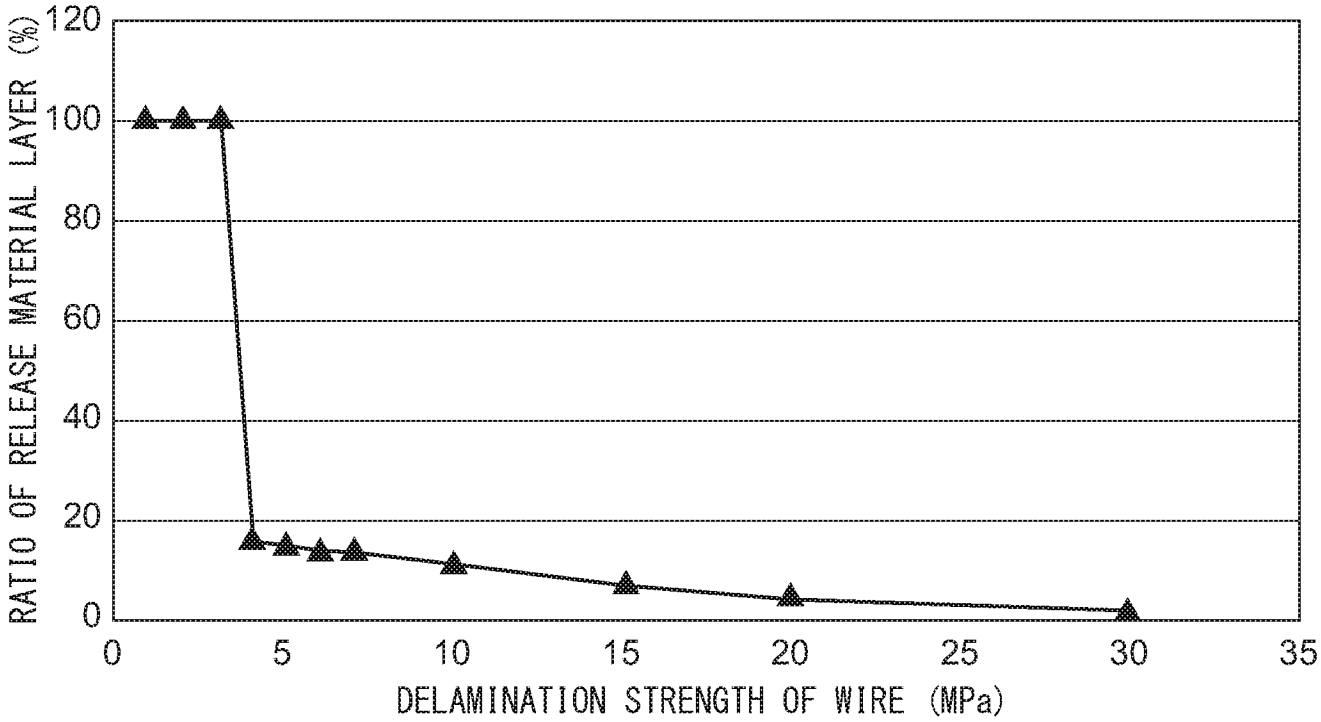
FIG. 3 is a graph of a delamination strength of a superconducting wire and a ratio of a length of a release material layer at an end portion to a length in a coil axial direction.

FIG. 3 is a graph plotted with a vertical axis representing a ratio of a length of the release material layer 3 at one side to a length in a coil axial direction and a horizontal axis representing a delamination strength of the superconducting wire 1. More specifically, with the entire superconducting wire 1 being impregnated with an epoxy resin, a stress in a coil radial direction (delamination direction) was analyzed, and as for the vertical axis, a ratio of a length in which a stress greater than or equal to the delamination strength indicated on the horizontal axis is produced to a length of the wire (6 mm) was calculated. The release material is used in a region where the stress is greater than or equal to the delamination strength on the horizontal axis, and thus the value described above is the ratio of the release material. The ratio of the length in the axial direction of the release material layer 3 to length in the coil axial direction of the superconducting wire 1 should be changed depending on the delamination strength of the superconducting wire 1 as shown in FIG. 3.

Herein, the delamination strength is a stress value which is a boundary at which the superconducting wire 1 begins to break by a stress (delamination force) acting on the superconducting wire 1 itself due to thermal shrinkage (damage such as delamination of layers forming the superconducting wire 1 begins to occur). In other words, a superconducting wire 1 having a delamination strength of 10 MPa means a superconducting wire 1 that breaks when a stress of greater than or equal to 10 MPa acts on the superconducting wire 1 itself.

It is to be noted that the ratio of the length in the axial direction of the release material layer 3 to the length in the coil axial direction of the superconducting wire 1 in FIG. 3 is effective when the delamination strength of the superconducting wire 1 is 4 MPa to 20 MPa.

As shown in FIG. 3, when fabricating a coil with a superconducting wire 1 having a delamination strength of less than or equal to 3 MPa, a stress (delamination force) of greater than or equal to 3 MPa acts on the entire wire, and thus it is necessary to impregnate the entirety with the release material layer 3. If, even in part, the resin layer 4 of epoxy resin is formed in place of the release material layer 3, the superconducting wire 1 will delaminate, and a critical current value Ic, which is a limit value of an electric current that can flow through the superconducting wire 1, will decrease.

In a case where the coil is fabricated with a superconducting wire 1 having a delamination strength of about 10 MPa, it is preferable to form a release material layer 3 for about 20% as a sum of both end portions (about 10% on each side) of the length of the superconducting wire 1 in an axial direction of the coil.

In a case where the coil is fabricated with a superconducting wire 1 having a delamination strength of about 20 MPa, it is preferable to form a release material layer 3 for about 10% as a sum of both end portions (about 5% on each side) of the length of the superconducting wire 1 in an axial direction of the coil.

In a case where the coil is fabricated with a superconducting wire 1 having a delamination strength of about 30 MPa, the delamination strength of the superconducting wire 1 is considerably great, and thus it can be considered that, even if almost an entirety of the length in the axial length of the coil is formed of a resin layer 4 of epoxy resin, delamination in the superconducting wire 1 will not occur.

Therefore, between the adjacent superconducting wires 1, a region where the release material layer 3 is formed is deemed to be a region where a stress acting in a delamination direction of the superconducting wire 1 exceeds the delamination strength of the superconducting wire 1.

The release material layer 3 is formed of a material having a smaller peel strength than the delamination strength of the superconducting wire 1. It is preferable that a release material of the release material layer 3 is, for example, at least one of cyanoacrylate adhesives, paraffin, a fluorine-based resin, grease, and silicone oil.

Further, as shown in FIG. 2A, the delamination force acting on the superconducting wire 1 is greater at an inner end portion of the superconducting coil 100 nearer to the core material 2 as compared to an outer end portion. Accordingly, as shown in FIG. 2B, the length of the release material layer 3 in the axial direction of the coil gradually decreases along a radial direction of the superconducting coil 100 from an inner side towards an outer side (see FIG. 2B, cross section A at an inner side of the coil to cross section C at an outer side of the coil).

(Resin Layer)

The resin layer 4 is formed between adjacent superconducting wires 1 at a region other than a region where the release material layer 3 is formed. The resin layer 4 is formed of a resin material that does not peel even if a stress due a difference in thermal shrinkage between resin and the superconducting wire 1 acts during the cooling.

A resin of the resin layer 4 is, for example, a thermosetting synthetic resin, and it is preferable that the thermosetting resin is at least one of an epoxy resin, a phenolic resin, a urea resin, and a melamine resin. The resin layer 4 is formed by applying and curing a liquid thermosetting resin on a periphery of the core material 2 and a side face of the superconducting wire 1, and thereafter, the release material layer 3 is formed by impregnating a release material (e.g., paraffin) to the portion where the resin layer 4 is not formed. By this impregnation, the release material layer 3 is formed not only between the superconducting wires 1 but also over the entire surface of the superconducting wire 1.

As described above, according to the superconducting coil 100 having the aforementioned structure, the release material layer 3 is formed between the superconducting wires 1 adjacent in the radial direction of the superconducting coil 100 and at both end portions in the axial direction of the superconducting coil 100, and the resin layer 4 is formed at a region other than the region where the release material layer 3 is formed. Accordingly, while maintaining the strength of the entire coil with the resin layer 4 and by forming the release material layer 3 only at a portion where a large thermal stress acts, the cooling efficiency of the coil can be improved. As a result of an improvement in the cooling efficiency of the coil, the coil is less likely to burnout by quenching and an operation of the coil can be stabilized.

Also, since the delamination force acting on both end portions of the superconducting wire 1 decreases from an inner side to an outer side in the radial direction of the coil, when the ratio of the release material layer 3 is decreased from an inner side to an outer side in the radial direction of the coil, the coil can be impregnated with more resin layer 4, and it is preferable for improving the strength of the coil.

Figure 4:
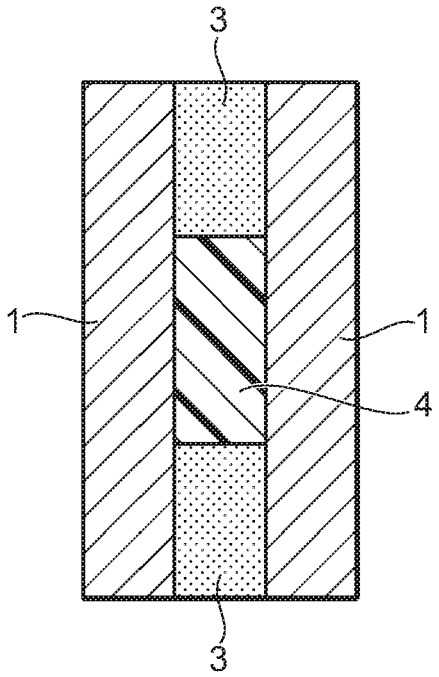
FIG. 4 is a cross-sectional view of a part of a superconducting coil comprising a single layer of coil (single pancake structure).

In the embodiment described above, a superconducting coil having a double pancake coil structure was explained by way of example. For a superconducting coil having a so-called single pancake structure, the release material layer 3 are to be formed at both end portions of the superconducting wire 1, respectively, as shown in FIG. 4.

EXAMPLES

Examples will be described below.

Example 1

Figure 5:
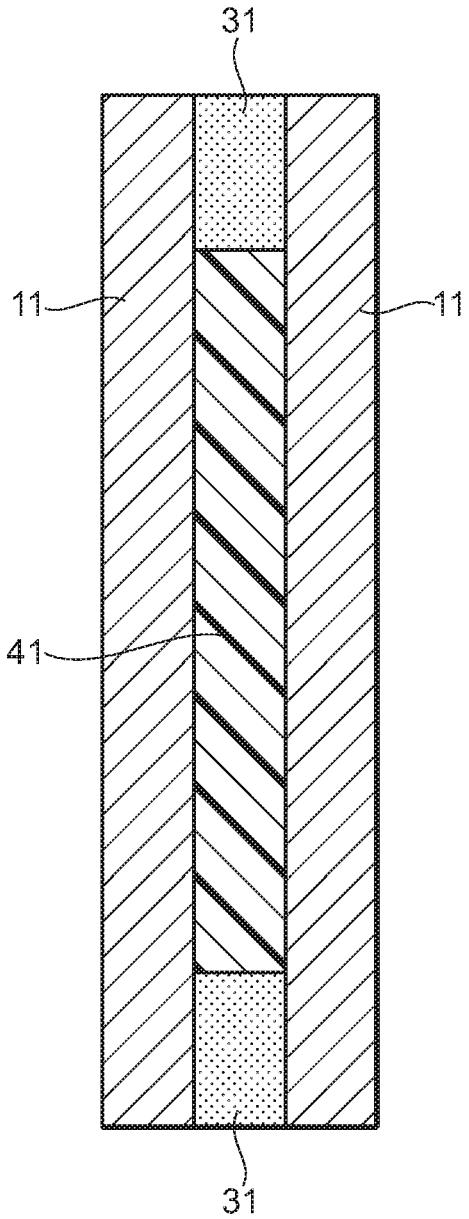
FIG. 5 is a cross-sectional view of a part of the superconducting coil in Example 1.

Referring to FIG. 5, a reel on which a superconducting wire 11 (SuperPower Inc.: width 6 mm, thickness 0.1 mm, critical current value Ic 170 A) is wound up is installed in a rotating unit of a winding machine, and an end of the superconducting wire 11 is secured to an inner cylinder (Ryoden Kasei Corporation: G10 (made of FRP), inner radius 58 mm, outer radius 60 mm) to be wound on.

Then, the superconducting wire 11 was subjected to a tension of 1 kgf, and the superconducting wire 11 was wound up into a coil form (coil inner radius 58 mm, coil outer radius 130 mm, single pancake type).

The superconducting wire 11 was wound into a coil form while applying a liquid epoxy resin to the superconducting wire 11 that extends between the reel and the winding-up inner cylinder, while leaving 15% of the length in the axial direction of the coil from each of the both end portions in the axial direction of the superconducting wire 11 to thereby impregnate 70% of the length in an axial direction of the coil excluding both end portions of the coil to form the resin layer 41. The epoxy resin used was ECCOSEAL W-19M2.

The coil which was impregnated with an epoxy resin at a central portion of superconducting wire 11 was stored at ambient temperature for 16 hours or more to cure the epoxy resin.

The coil was placed in a vacuum device and an end portion of the superconducting wire 11 which was not impregnated in the previous step was vacuum impregnated with a release material to form the release material layer 31. The release material used was ParaffinWax-135 available from Nippon Seiro Co., Ltd.

The vacuum impregnated coil was stored at ambient temperature for 16 hours or more to cure the release material.

The coil was placed in a cryostat, and cooled and an electric current was supplied by conduction cooling using a conduction cooler having a heat absorption capability of 50 W at 30K.

As shown in Table 1, evaluation was carried out based on three evaluation items below.

(1) Critical Current Value Ic

A critical current value Ic of the coil was measured when an electric current is flowing through the coil. As shown in Table 1, the critical current value Ic of the coil was evaluated as: (A) very good when the value was greater than or equal to 170 A; (B) good when the value was greater than or equal to 130 A and less than 170 A; (C) poor when the value was greater than or equal to 100 A and less than 130 A; and (D) very poor when the value was less than 100 A.

(2) Damage in the Superconducting Wire

The coil was cooled to 30 K and brought back to ambient temperature again, and thereafter, the superconducting wire forming the coil was observed. As shown in Table 1, it was evaluated as: (A) very good when there was no delamination in the superconducting wire; (B) good when delamination at an end portion in the coil axial direction of the superconducting wire was less than or equal to 1 mm; (C) poor when delamination at an end portion in the coil axial direction of the superconducting wire was greater than 1 mm and less than or equal to 2 mm; and (D) very poor when poor when delamination at an end portion in the coil axial direction of the superconducting wire was greater than 2 mm.

(3) Temperature of the Coil

The temperature at an electrode provided on an outer periphery of the coil was measured and taken as a coil temperature. As shown in Table 1, the temperature of the coil was evaluated as: (A) very good when the temperature was less than or equal to 30 K; (B) good when the temperature was greater than 30 K and less than or equal to 35 K; (C) poor when the temperature was greater than 35 K and less than or equal to 40 K; and (D) very poor when the temperature was greater than 40 K.

Results based on these evaluation items are shown in Table 2.

The results showed that the critical current value Ic was 170 A and a drop in the critical current value Ic was not observed, which was evaluated as A. Further, when the coil was removed from the cryostat and observed at ambient temperature, the release material layer 31 was broken, but there were no damages in the epoxy resin (resin layer 41) and the superconducting wire 11, and it was evaluated as A. Further, the coil was cooled to 30 K, which was evaluated as A.

Example 2

In Example 2, the ratio of the resin layer was increased as compared to Example 1. Other than this, the superconducting wire and winding conditions of the superconducting wire were the same as those of Example 1.

Figure 6:
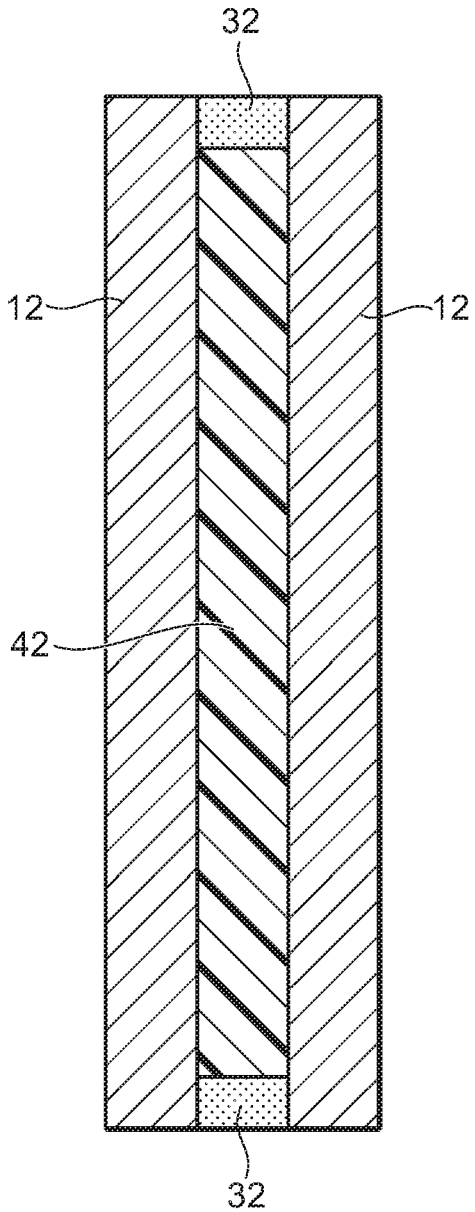
FIG. 6 is a cross-sectional view of a part of the superconducting coil in Example 2.

Specifically, as shown in FIG. 6, the superconducting wire 12 was wound into a coil form while applying a liquid epoxy resin to the superconducting wire 12 that extends between the reel and the winding-up inner cylinder, while leaving 5% of the length in the axial direction of the coil from each of the both end portions in the axial direction of the superconducting wire 12 to thereby impregnate 90% of the length in an axial direction of the coil excluding both end portions in the axial direction of the coil to form the resin layer 42. The epoxy resin used was ECCOSEAL W-19M2.

The coil which was impregnated with an epoxy resin at a central portion of superconducting wire 12 was stored at ambient temperature for 16 hours or more to cure the epoxy resin.

The coil was placed in a vacuum device and an end portion of the superconducting wire 12 which was not impregnated in the previous step was vacuum impregnated with a release material to form the release material layer 32. The release material used was ParaffinWax-135 available from Nippon Seiro Co., Ltd.

The vacuum impregnated coil was stored at ambient temperature for 16 hours or more to cure the release material.

The coil was placed in a cryostat, and cooled and an electric current was supplied by conduction cooling using a conduction cooler having a heat absorption capability of 50 W at 30K.

The evaluation was carried out similarly to Example 1.

Results based on the evaluation items are shown in Table 2.

The results showed that the critical current value Ic was 165 A and a drop in the critical current value Ic was observed, which was evaluated as B. Further, when the coil was removed from the cryostat and observed at ambient temperature, the epoxy resin (resin layer 42) and the superconducting wire 12 were peeled at an upper part of the superconducting wire 12 for a width of 0.3 mm, and a break was observed, and it was evaluated as B. Further, the coil was cooled to 29 K, which was evaluated as A.

Example 3

In Example 3, the ratio of the resin layer was decreased as compared to Example 1. Other than this, the superconducting wire and winding conditions of the superconducting wire were the same as those of Example 1.

Figure 7:
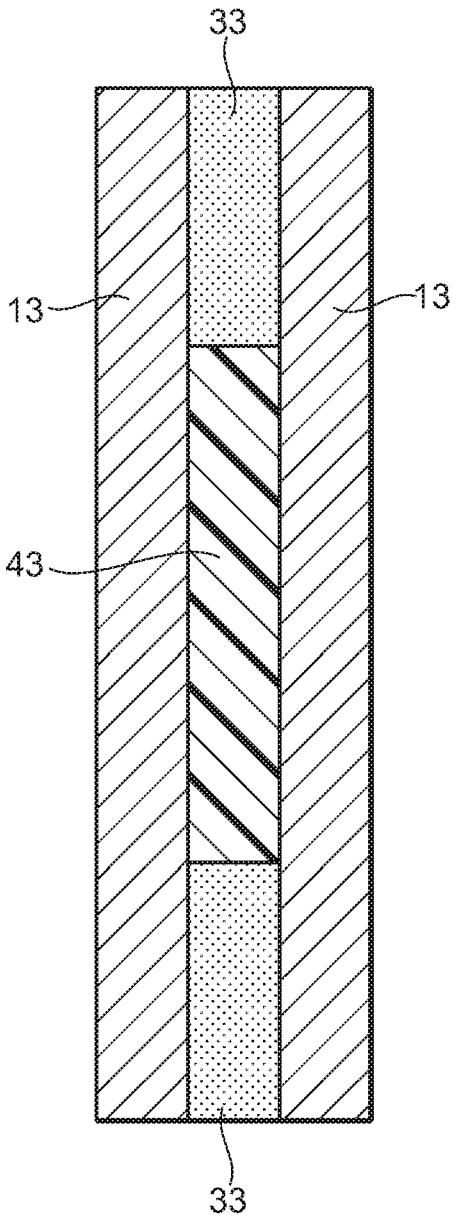
FIG. 7 is a cross-sectional view of a part of the superconducting coil in Example 3.

Specifically, as shown in FIG. 7, the superconducting wire 13 was wound into a coil form while applying a liquid epoxy resin to the superconducting wire 13 that extends between the reel and the winding-up inner cylinder, while leaving 25% of the length in the axial direction of the coil from each of the both end portions in the axial direction of the superconducting wire 13 to thereby impregnate 50% of the length in an axial direction of the coil excluding both end portions in the axial direction of the coil to form the resin layer 43. The epoxy resin used was ECCOSEAL W-19M2.

The coil which was epoxy impregnated at a central portion of superconducting wire 13 was stored at ambient temperature for 16 hours or more to cure the epoxy resin.

The coil was placed in a vacuum device and an end portion of the superconducting wire 13 which was not impregnated in the previous step was vacuum impregnated with a release material to form the release material layer 33. The release material used was ParaffinWax-135 available from Nippon Seiro Co., Ltd.

The vacuum impregnated coil was stored at ambient temperature for 16 hours or more to cure the release material.

The coil was placed in a cryostat, and cooled and an electric current was supplied by conduction cooling using a conduction cooler having a heat absorption capability of 50 W at 30K.

The evaluation was carried out similarly to Example 1.

Results based on the evaluation items are shown in Table 2.

The results showed that the critical current value Ic was 160 A and a drop in the critical current value Ic was observed, which was evaluated as B. Further, when the coil was removed from the cryostat and observed at ambient temperature, the epoxy resin (resin layer 43) and the superconducting wire 13 were peeled at an upper part of the superconducting wire 13 for a width of 0.3 mm, and a break was observed, and it was evaluated as B. Further, the coil was cooled to 33 K, which was evaluated as B.

Example 4

In Examples 1 to 3, the release material in a liquid form was used, and the coil was impregnated with a liquid release material, whereas in Example 4, a coil was fabricated using a fluorine resin tape having an adhesive layer. Except for the release material, those which are the same as Example 1 are used.

Figure 8:
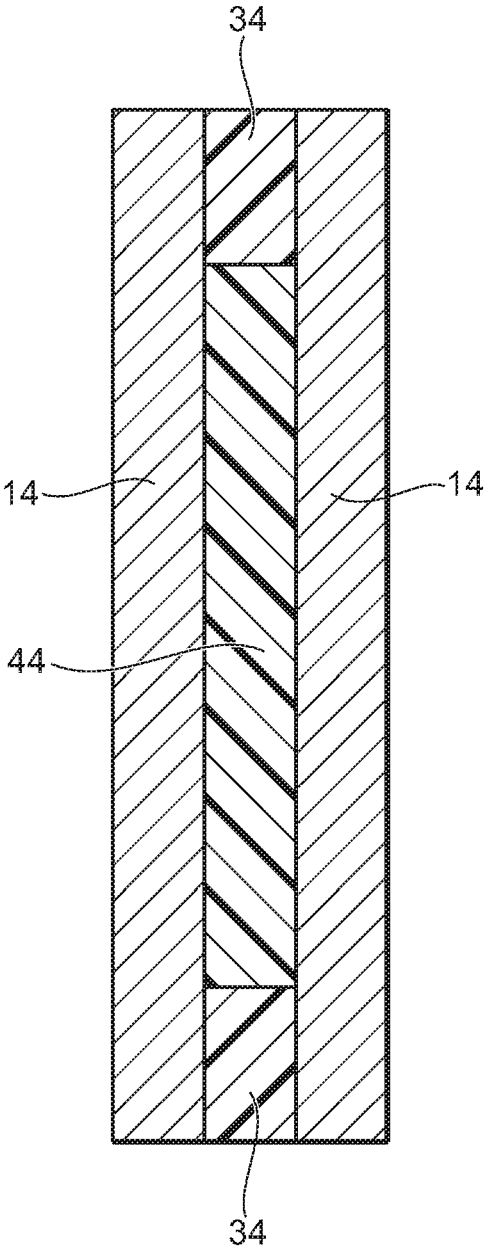
FIG. 8 is a cross-sectional view of a part of the superconducting coil in Example 4.

Specifically, referring to FIG. 8, the reel on which the superconducting wire 14 is wound up is mounted in a rotating unit of a winding machine and an end of the superconducting wire 14 is secured to a winding inner cylinder. Then, the superconducting wire 14 was subjected to a tension of 1 kgf, and the superconducting wire 14 and the fluorine resin tape 34 were formed into a coil by co-winding. The co-winding of the fluorine resin tape 34 was performed only at a region of the superconducting wire 14 that is 15% of the length in the axial direction of the coil from both end portions in an axial direction of the coil.

The coil was placed in a vacuum device and vacuum impregnation was carried out with an epoxy resin to form a resin layer 44 at the remaining portion. The coil removed from the impregnation container was stored at an ambient temperature for 16 hours or more to cure the epoxy resin.

The coil was placed in a cryostat, and cooled and an electric current was supplied by conduction cooling using a conduction cooler having a heat absorption capability of 50 W at 30K.

The evaluation was carried out similarly to Example 1.

Results based on the evaluation items are shown in Table 2.

The results showed that the critical current value Ic was 170 A and a drop in the critical current value Ic was not observed, which was evaluated as A. Further, when the coil was removed from the cryostat and observed at ambient temperature, the fluorine resin tape 34 was broken, but there were no damages in the epoxy resin (resin layer 44) and the superconducting wire 14, and it was evaluated as A. Further, the coil was cooled to 30 K, which was evaluated as A.

Comparative Example 1

In Comparative Example 1, impregnation was carried out with an epoxy resin only. In other words, between the superconducting wires, only the resin layer was formed and a release material layer was not formed. Other than this, the superconducting wire and winding conditions of the superconducting wire were the same as those of Example 1.

Figure 9:
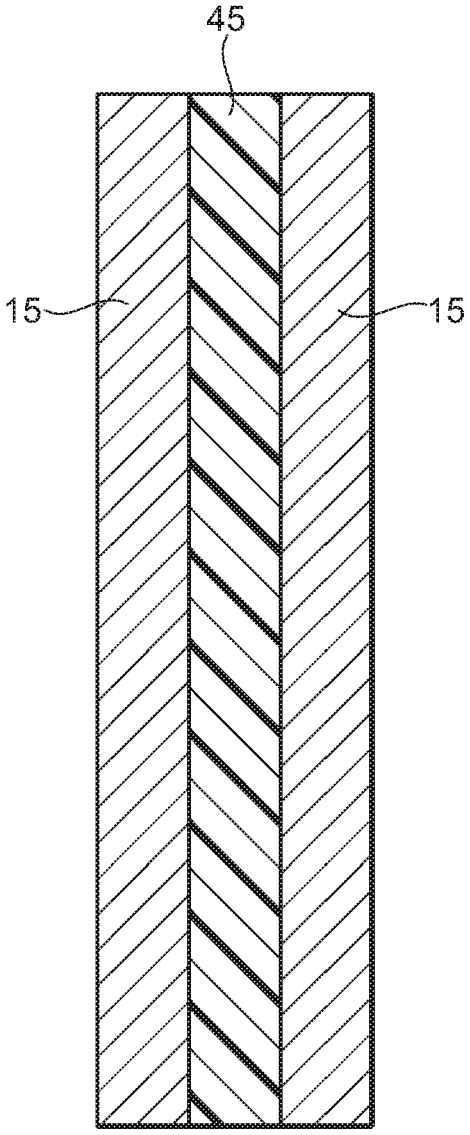
FIG. 9 is a cross-sectional view of a part of the superconducting coil in Comparative Example 1.

Specifically, as shown in FIG. 9, the superconducting wire 15 was wound into a coil form while applying soaking a sufficient amount of a liquid epoxy resin to the superconducting wire 15 that extends between the reel and the winding-up inner cylinder thereby impregnate an entirety of the coil to form the resin layer 45. The epoxy resin used was ECCOSEAL W-19M2.

The coil which was impregnated with an epoxy resin was stored at ambient temperature for 16 hours or more to cure the epoxy resin.

The coil was placed in a cryostat, and cooled and an electric current was supplied by conduction cooling using a conduction cooler having a heat absorption capability of 50 W at 30K.

The evaluation was carried out similarly to Example 1.

Results based on the evaluation items are shown in Table 3.

The results showed that the critical current value Ic was 95 A and a large drop in the critical current value Ic was observed, which was evaluated as D. Further, when the coil was removed from the cryostat and observed at ambient temperature, the epoxy resin (resin layer 45) and the superconducting wire 15 were peeled at an upper part of the superconducting wire 15 over a width of 2 mm, and a break was observed, and it was evaluated as C. Further, the coil was cooled to 28 K, which was evaluated as A.

Comparative Example 2

In Comparative Example 2, the ratio of the resin layer was further increased as compared to Examples 1 and 2. Other than this, the superconducting wire and winding conditions of the superconducting wire were the same as those of Example 1.

Figure 10:
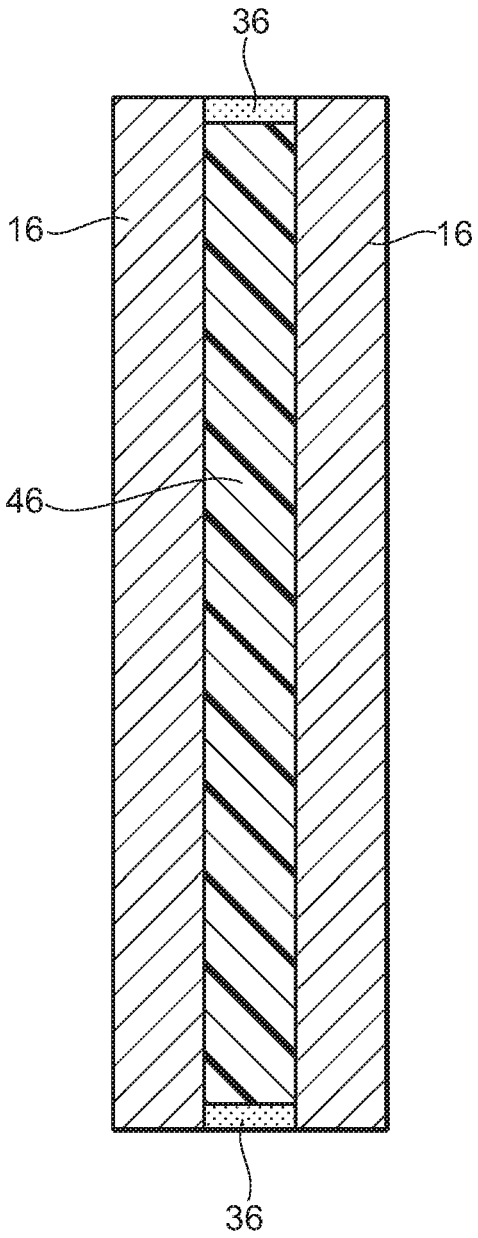
FIG. 10 is a cross-sectional view of a part of the superconducting coil in Comparative Example 2.

Specifically, referring to FIG. 10, the superconducting wire 16 was wound into a coil form while applying a liquid epoxy resin to the superconducting wire 16 that extends between the reel and the winding-up inner cylinder, while leaving 2.5% of the length in the axial direction of the coil from each of the both end portions in the axial direction of the superconducting wire 16 to thereby impregnate 95% of the length in an axial direction of the coil excluding both end portions in the axial direction of the coil to form the resin layer 46. The epoxy resin used was ECCOSEAL W-19M2.

The coil which was epoxy impregnated at a central portion of superconducting wire 16 was stored at ambient temperature for 16 hours or more to cure the epoxy resin.

The coil was placed in a vacuum device and an end portion of the superconducting wire 16 which was not impregnated in the previous step was vacuum impregnated with a release material to form the release material layer 36. The release material used was ParaffinWax-135 available from Nippon Seiro Co., Ltd.

The vacuum impregnated coil was stored at ambient temperature for 16 hours or more to cure the release material.

The coil was placed in a cryostat, and cooled and an electric current was supplied by conduction cooling using a conduction cooler having a heat absorption capability of 50 W at 30K.

The evaluation was carried out similarly to Example 1.

Results based on the evaluation items are shown in Table 3.

The results showed that the critical current value Ic was 110 A and a drop in the critical current value Ic was observed, which was evaluated as C. Further, when the coil was removed from the cryostat and observed at ambient temperature, the epoxy resin (resin layer 46) and the superconducting wire 16 were peeled at an upper part of the superconducting wire 16 over a width of 1.5 mm, and a break was observed, and it was evaluated as C. Further, the coil was cooled to 28 K, which was evaluated as A.

Comparative Example 3

In Comparative Example 3, the ratio of the resin layer was decreased as compared to Examples 1 and 3. Other than this, the superconducting wire and winding conditions of the superconducting wire were the same as those of Example 1.

Figure 11:
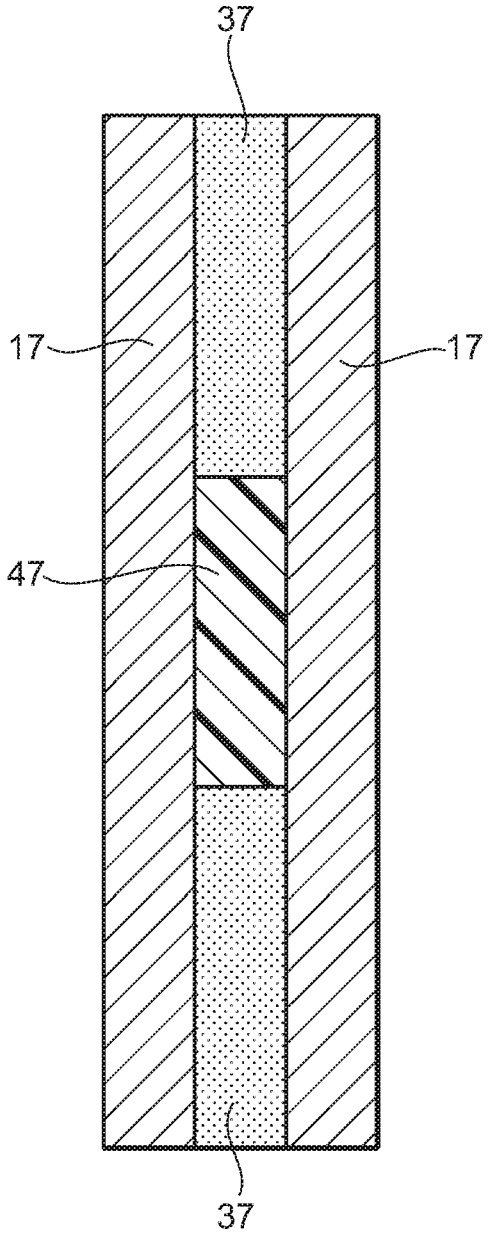
FIG. 11 is a cross-sectional view of a part of the superconducting coil in Comparative Example 3.

Specifically, referring to FIG. 11, the superconducting wire 17 was wound into a coil form while applying a liquid epoxy resin to the superconducting wire 17 that extends between the reel and the winding-up inner cylinder, while leaving 35% of the length in the axial direction of the coil from each of the both end portions in the axial direction of the superconducting wire 17 to thereby impregnate 30% of the length in an axial direction of the coil excluding both end portions in the axial direction of the coil to form the resin layer 47. The epoxy resin used was ECCOSEAL W-19M2.

The coil which was epoxy impregnated at a central portion of superconducting wire 17 was stored at ambient temperature for 16 hours or more to cure the epoxy resin.

The coil was placed in a vacuum device and an end portion of the superconducting wire 17 which was not impregnated in the previous step was vacuum impregnated with a release material to form the release material layer 37. The release material used was ParaffinWax-135 available from Nippon Seiro Co., Ltd.

The vacuum impregnated coil was stored at ambient temperature for 16 hours or more to cure the release material.

The coil was placed in a cryostat, and cooled and an electric current was supplied by conduction cooling using a conduction cooler having a heat absorption capability of 50 W at 30K.

The evaluation was carried out similarly to Example 1.

Results based on the evaluation items are shown in Table 3.

The results showed that the critical current value Ic was 155 A and a drop in the critical current value Ic was observed, which was evaluated as B. Further, when the coil was removed from the cryostat and observed at ambient temperature, the epoxy resin (resin layer 47) and the superconducting wire 17 were peeled at an upper part of the superconducting wire 17 over a width of 0.3 mm, and a break was observed, and it was evaluated as B. Further, the coil was cooled only to 36 K, which was evaluated as C.

Comparative Example 4

In Comparative Example 4, the ratio of the resin layer was decreased as compared to Examples 1 and 3. Other than this, the superconducting wire and winding conditions of the superconducting wire were the same as those of Example 1.

Figure 12:
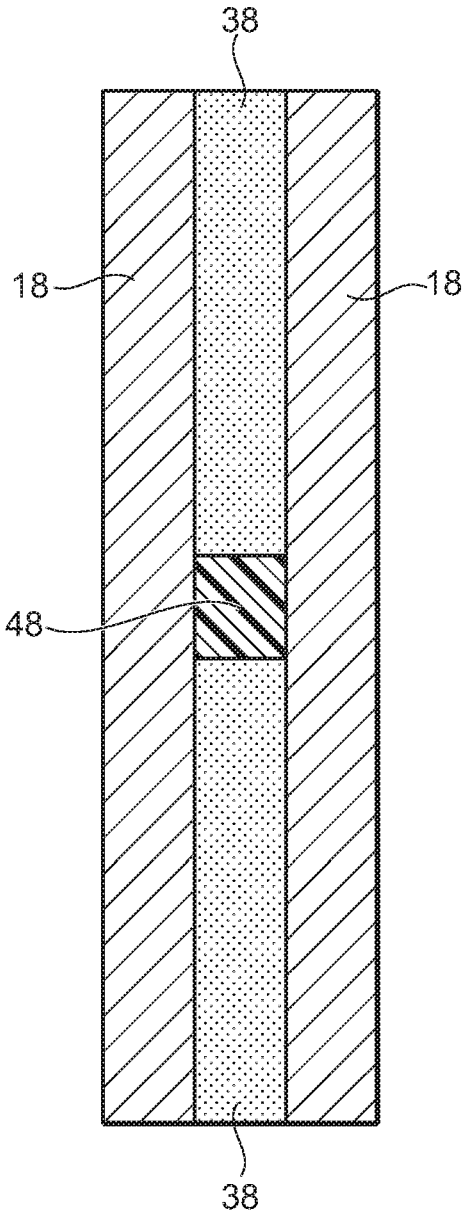
FIG. 12 is a cross-sectional view of a part of the superconducting coil in Comparative Example 4.

Specifically, referring to FIG. 12, the superconducting wire 18 was wound into a coil form while applying a liquid epoxy resin to the superconducting wire 18 that extends between the reel and the winding-up inner cylinder, while leaving 45% of the length in the axial direction of the coil from each of the both end portions in the axial direction of the superconducting wire 18 to thereby impregnate 10% of the length in an axial direction of the coil excluding both end portions in the axial direction of the coil to form the resin layer 48. The epoxy resin used was ECCOSEAL W-19M2.

The coil which was impregnated with an epoxy resin at a central portion of superconducting wire 18 was stored at ambient temperature for 16 hours or more to cure the epoxy resin.

The coil was placed in a vacuum device and an end portion of the superconducting wire 18 which was not impregnated in the previous step was vacuum impregnated with a release material to form the release material layer 38. The release material used was ParaffinWax-135 available from Nippon Seiro Co., Ltd.

The vacuum impregnated coil was stored at ambient temperature for 16 hours or more to cure the release material.

The coil was placed in a cryostat, and cooled and an electric current was supplied by conduction cooling using a conduction cooler having a heat absorption capability of 50 W at 30K.

The evaluation was carried out similarly to Example 1.

Results based on the evaluation items are shown in Table 2.

The results showed that the critical current value Ic was 152 A and a drop in the critical current value Ic was observed, which was evaluated as B. Further, when the coil was removed from the cryostat and observed at ambient temperature, the release material layer 38 was broken, but there were no damages in the epoxy resin (resin layer 48) and the superconducting wire 18, and it was evaluated as A. Further, the coil was cooled only to 50 K, which was evaluated as D.

Comparative Example 5

In Comparative Example 5, impregnation was carried out with paraffin only. In other words, between the superconducting wires, only a release material layer 39 was formed and the resin layer was not formed. Other than this, the superconducting wire and winding conditions of the superconducting wire were the same as those of Example 1.

Figure 13:
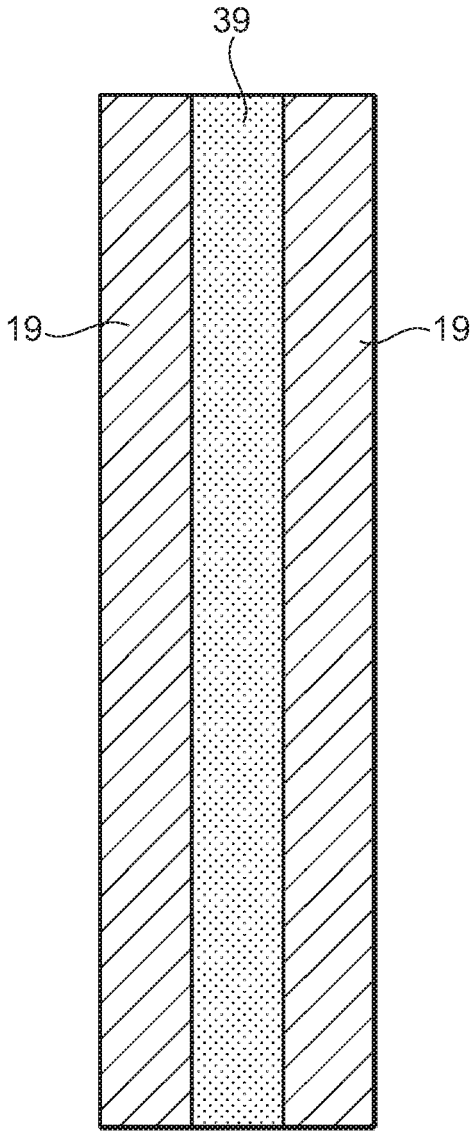
FIG. 13 is a cross-sectional view of a part of the superconducting coil in Comparative Example 5.

Specifically, referring to FIG. 13, the wound coil was removed from the winding machine and placed in a vacuum impregnation device. Using a release material which is made into a liquid form by heating to 120° C., and an entirety of the coil was vacuum impregnated. The release material used was ParaffinWax-135 available from Nippon Seiro Co., Ltd.

The coil impregnated with the release material was stored at ambient temperature for 16 hours or more to cure the release material.

The coil was placed in a cryostat, and cooled and an electric current was supplied by conduction cooling using a conduction cooler having a heat absorption capability of 50 W at 30K.

The evaluation was carried out similarly to Example 1.

Results based on the evaluation items are shown in Table 3.

The results showed that the critical current value Ic was 150 A and a large drop in the critical current value Ic was observed, which was evaluated as B. Further, when the coil was removed from the cryostat and observed at ambient temperature, the release material layer 39 was broken, but a break in the superconducting wire 19 was observed, and it was evaluated as A. Further, the coil was cooled only to 41 K, which was evaluated as D. It is considered to be because of a decrease in the cooling efficiency of the coil due to the production of a crack.

TABLE 1

| | A | B | C | D |
|---|---|---|---|---|
| Critical Current (A) | 170≤ | <170 130≤ | <130 100≤ | <100 |
| Delamination of Wire (mm) | None | ≤1 mm | 1 mm< ≤2 mm | 2 mm< |
| Coil Temperature (K) | ≤30 | 30< ≤5 | 35< ≤40 | 40< |

TABLE 2

| | EXAMPLE 1 | EXAMPLE 2 | EXAMPLE 3 | EXAMPLE 4 |
|---|---|---|---|---|
| Critical Current | A | B | B | A |
| Damage in Wire | A | B | B | A |
| Coil Temperature | A | A | B | A |
| Ratio of Release Material | 30 | 10 | 50 | 30 |

TABLE 3

| | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 |
|---|---|---|---|---|---|
| Critical Current | D | C | B | B | B |
| Damage in Wire | C | C | B | A | A |

TABLE 3-continued

| | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 |
|---|---|---|---|---|---|
| Coil Temperature | A | A | C | D | D |
| Ratio of Release Material | 0 | 5 | 70 | 90 | 100 |

(Evaluation Result)

As shown in Tables 1 to 3, by forming a resin layer and a release material layer between superconducting wires, a superconducting coil can be fabricated which is improved as compared to a case where only one of a resin layer and a release material is formed. Also, it is elucidated that, by adjusting the ratio of the release material layer and the resin layer depending on the delamination strength of the superconducting wire, a superconducting coil having an improved cooling efficiency can be fabricated without lowering the critical current value Ic and without producing peelings in the superconducting wire. Also, it was found that, as the ratio of the release material layer becomes greater, an evaluation for the critical current and an evaluation for damages in the superconducting wire becomes better, but an evaluation for the temperature of the coil becomes worse. It was found, however, that when the ratio of the release material layer is too high, an evaluation of the temperature of the coil becomes worse and even if there is no damages in the superconducting wire, an evaluation of the critical current becomes worse.

What is claimed is:

1. A superconducting coil comprising:

a superconducting wire wound around an axis;

a release material layer between the superconducting wires adjacent in a radial direction and at both ends in an axial direction of the superconducting coil;

a resin layer between the superconducting wires adjacent in the radial direction and in a region other than another region where the release material layer is formed; and wherein a length of the release material layer in the axial direction is 10% to 50% of a length of the superconducting wire in the axial direction, and on a same face of the superconducting wire upon which the release material layer and the resin layer are formed.

2. The superconducting coil according to claim 1, wherein the length of the release material layer in the axial length becomes shorter from an inner side to an outer side along a radial direction of a coil.

3. The superconducting coil according to claim 1, wherein a release material of the release material layer is at least one of a cyanoacrylate-based adhesive, paraffin, a fluorine-based resin, grease, and silicone oil.

4. The superconducting coil according to claim 1, wherein a release material of the release material layer is a resin tape having an adhesive layer.

5. The superconducting coil according to claim 1, wherein a resin of the resin layer is a thermosetting synthetic resin.

6. The superconducting coil according to claim 5, wherein the thermosetting synthetic resin is at least one of an epoxy resin, a phenolic resin, a urea resin, and a melamine resin.

7. The superconducting coil according to claim 5, wherein the resin layer is formed by impregnation of the thermosetting synthetic resin.

* * * * *